United States Patent [19]

Gotanda

[11] Patent Number: 4,993,760

[45] Date of Patent: Feb. 19, 1991

[54] DOOR CHAIN-LOCKING DEVICE

[76] Inventor: Motohiro Gotanda, 1802-10, Nakabiyo, Abiko-shi, Chiba-ken, Japan

[21] Appl. No.: 485,201

[22] Filed: Feb. 26, 1990

[51] Int. Cl.[5] ..... E05C 19/08

[52] U.S. Cl. ..... 292/264; 292/DIG. 41

[58] Field of Search ..... 292/264, 262, DIG. 41, 292/DIG. 44, DIG. 60; 70/93

[56] References Cited

U.S. PATENT DOCUMENTS

| | | | |
|---|---|---|---|
| 807,779 | 12/1905 | Rinald | 292/264 |
| 832,420 | 10/1906 | Rinaldy | 292/264 |
| 1,575,429 | 3/1926 | Lawrence | 292/264 |
| 1,850,367 | 3/1932 | Winter | 292/264 |
| 2,881,611 | 4/1959 | Callegari | 292/264 |
| 3,071,958 | 1/1963 | Russo | 292/264 |
| 3,762,752 | 10/1973 | Saunders | 292/264 |
| 3,894,762 | 7/1975 | Segal | 292/264 |
| 3,950,019 | 4/1976 | Dugan | 292/264 |

FOREIGN PATENT DOCUMENTS

| | | | |
|---|---|---|---|
| 321918 | 6/1920 | Fed. Rep. of Germany | 292/264 |
| 331644 | 11/1935 | Italy | 292/264 |

*Primary Examiner*—Eric K. Nicholson
*Attorney, Agent, or Firm*—Jordan and Hamburg

[57] ABSTRACT

A door chain-locking device comprises a door-frame side locking unit and a door side locking unit. The frame-side locking unit has a locking bolt for permanently securing thereon the fixed-end link of a chain and a case for fixing the locking bolt. The door-side locking unit has an engaging bolt operable to engage thereon one of the middle part's links of the chain fixed at its fixed end link to the door-frame side locking bolt and also to engage the free-ended link of the chain when the door is being closed and to be lifted out of engagement with the free-end link of the chain after disengagement of the middle part's link therefrom.

13 Claims, 5 Drawing Sheets

DOOR CHAIN-LOCKING DEVICE

BACKGROUND OF THE INVENTION

The present invention relates to a device for fastening and releasing a door's chain lock, which is capable of being released by hand.

Conventional door locking chains simply serve to prevent the possible illegal intrusion of strangers such as, for example, an importunate peddler and so on, by limiting the door opening to a certain degree thereby only allowing the receiving of letters or of seeing the face of an unspecified person.

As described above, a conventional chain lock has the drawback that it allows the door to be opened from the outside to the degree corresponding to the length of the door's lock only by means of a chain which is not secured by a lock. Namely, in such a case there may be a lock of security against persons peeping or throwing dangerous substances into the inside of the door's opening. No protection is provided from intrusion into the interior by the cutting of the chain.

SUMMARY OF THE INVENTION

It is an object of the present invention to provide a door chain lock which is capable of keeping the door completely locked and also of being manually disengaged when the door has to be opened.

BRIEF DESCRIPTION OF THE DRAWINGS

FIG. 3(*a*) is a side view;

FIG. 3(*b*) is a bottom view;

FIG. 3(*c*) is a rear view;

FIG. 3(*d*) is a cross section taken on line IIId–IIId of FIG. 3(c ;

DESCRIPTION OF THE PREFERRED EMBODIMENTS

A door chain locking device for fastening and releasing a door according to the present invention, comprises a door-frame side chain locking unit, which has a locking bolt for permanently securing the end link of a chain and a case for fixing the locking bolt, a door-side chain locking unit, which has an engaging-bolt adapted to engage thereon one of the middle part's links of the chain fixed at its fixed-end link to the locking bolt and also to engage thereon a free-end link of the chain when the door is being closed and to be lifted out with the free-end link of the chain after disengaging the middle part's link therefrom.

It is also effective in that in the door-side chain locking unit, a spring is provided to prevent the lowering of the once lifted engaging bolt by engaging a portion of the engaging bolt.

In a door chain locking device, according to the present invention, since a chain is permanently fixed at one end (hereinafter called the fixed end) to a case on the door-frame side, the fastening and releasing operations are performed by using an engaging-bolt of a chain locking unit on the door. Accordingly, it is possible to completely lock the door with the chain only (without using the door lock ) and also to release the chain by lifting the engaging bolt out of the other free end-link of the chain. The engaging bolt can also be kept in the upper position by the action of a movable spring to engage a specific portion of said bolt upon the movement of the latter to a specific upper position. When the engaging bolt is lifted, a spring engages the specific portion of the engaging-bolt so as to prevent the latter from lowering.

Figure 1:
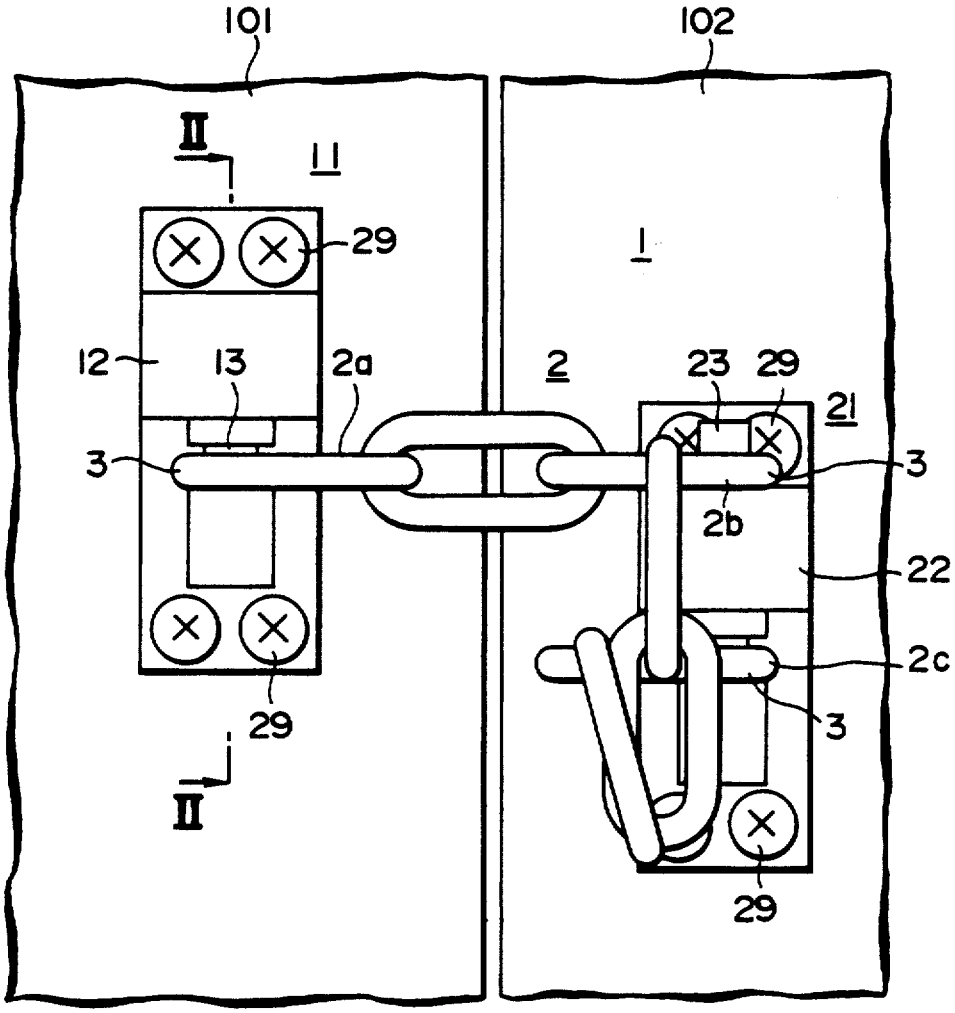
FIG. 1 is a front view showing an embodiment of the present invention.
Figure 2:
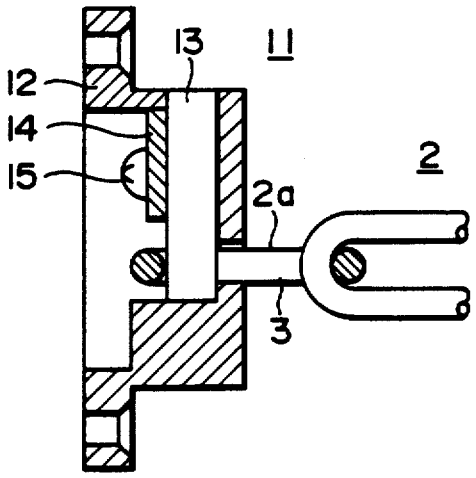
FIG. 2 is a cross section taken on line II—II of FIG. 1.

FIG. 1 is a front view showing an embodiment of the present invention and FIG. 2 is a cross section taken on line II–II of FIG. 1. FIGS. 3(*a*)–(*d*) show a door side chain locking unit shown in FIG. 1: FIG.3(*a*) is a side view, FIG. 3(*b*) is a bottom view, FIG. 3(*c*) is a rear view and FIG. 3(*d*) is a cross section taken on line IIId–IIId of FIG. 3(*c*).

In there drawings, numerals 101 and 102 designate a door frame and a door respectively and numeral 1 designates the whole of a door chain locking device which comprises a chain 2 having links 3. The door frame 101 carries a frame side chain locking unit 11 comprising case 12, a locking bolt 13, a pressure plate 14 for pressing the lock bolt 13 and a screw 15 for securing the pressure plate 14 to the case 12.

Figure 4:
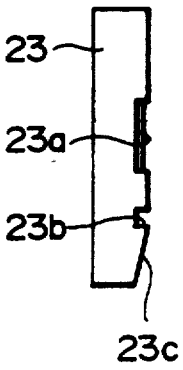
FIGS. 4(*a*) and 4(*b*) are respectively a sectional view and a rear view of the lock bolt shown in FIG. 3.
Figure 4:
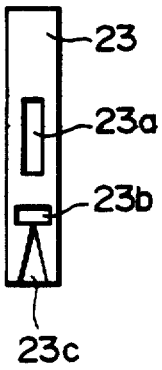

The door 102 carries a door-side chain locking unit 21 comprising a case 22, an engaging bolt 23 for engaging thereon links 3 of the middle part's link **2*b* and the free end link 2*c* of the chain. FIGS. 4**(*a*) and 4(*b*) show the details of said engaging bolt. In FIGS. 4(*a*) and 4(*b*), numeral **23*a* is a groove for guiding the engaging bolt 23, 23*b* is an engaging groove, 23*c* is an engaging portion, and in FIGS. 3**(*c*) and 3(*d*), 24 is a pressure plate, 25 is a spring for engaging the engaging portion of the engaging bolt, 26 is a screw for securing the pressure plate to the case 22, 27 is a screw engaging the guiding-groove **23*a* of the engaging bolt 23, 28 is a screw for securing the spring 25 to the case 22, 29 in FIG. 1 are screws for securing the case 12 to the door frame 101 and screws for securing the case 22 to the door 102**.

The operation of the device is as follows:

The chain lock unit 11 on the door frame is intended to constantly secure the fixed-end link **2*a* of the chain 3 in the engaged state, eliminating the possibility of disengaging said chain link. Accordingly, the chain 2 of the chain locking device is fastened or released by hand on the door 102**.

When the link 3 of the middle part's link **2*b* of the chain 2 is engaged on the upper portion of the door side engaging bolt 23 after the engagement of a link 3 of the chain's free end link 2*c* on said engaging bolt, the chain 2 is stretched to lock the door as illustrated in FIG. 1 and the door 102** cannot be opened without closing the door lock (not shown) on the door.

Figure 5:
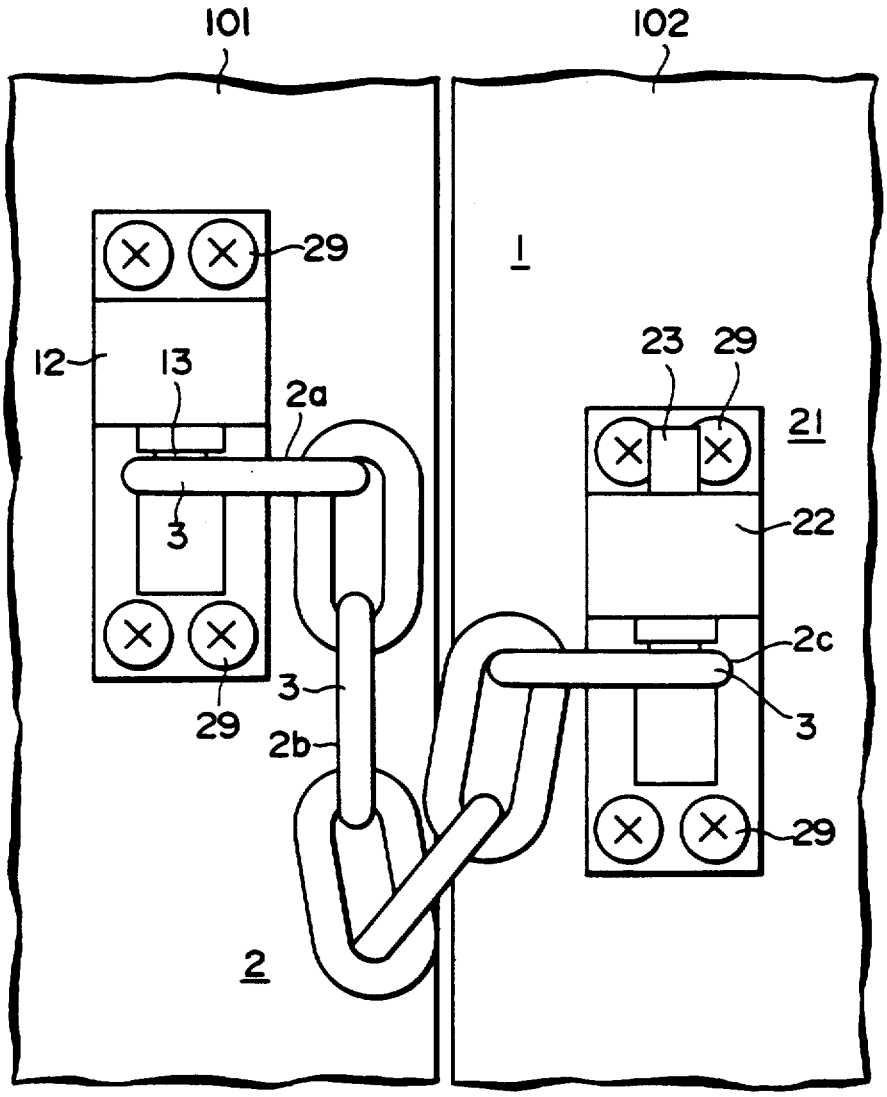
FIG. 5 is a front view showing a door chain locking device with the chain with its middle part's link being removed from the engaging bolt.

When the link 3 of the middle part's link **2*b* of the chain 2 is disengaged from the door-side engaging bolt 23, the chain 2 is loosened to allow the door to be opened to a specified degree as illustrated in FIG. 5**. The case shown is the same as a conventional door chain.

Figure 6A:
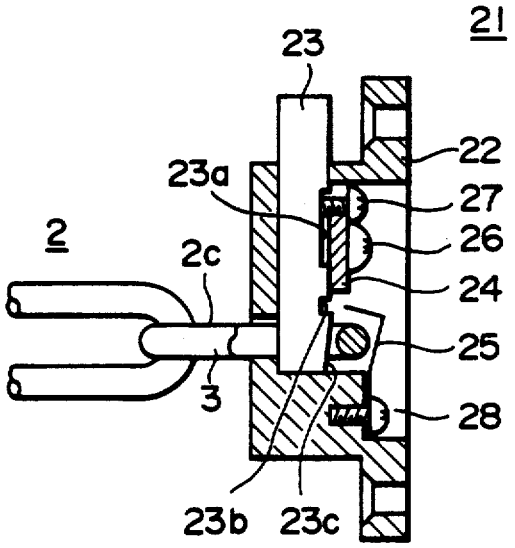
FIGS. 6(*a*) and (*b*) are views showing the operation of a chain locking unit on the door side.
Figure 6B:
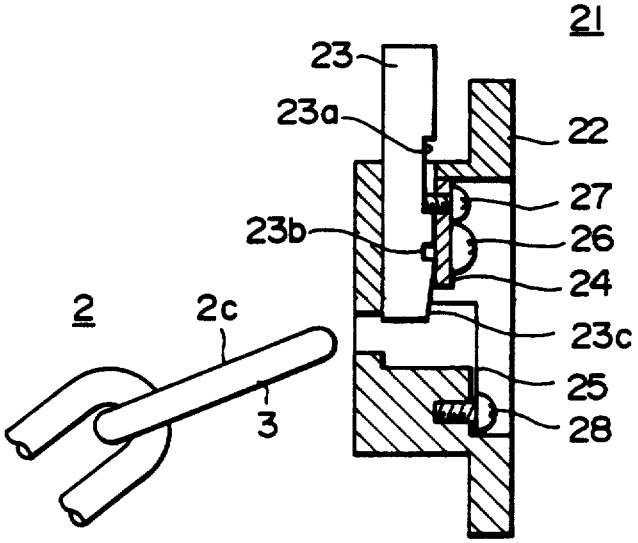

Disengaging the link 3 of the free end link **2*c* of the chain 3** from the door-side chain locking unit is carried out by hand as follows:

Press the free end link 2c of the chain to push the spring 25 out of its engagement with the groove 23b, and then slide up the engaging bolt 23 by holding its upper part as shown in FIG. 6(b). The link 3 is released and therefore the door 102 can be fully opened.

Further, the case of engaging the link 3 of the free end 2c of the chain 2 onto the door-side chain locking unit will be explained.

Figure 3A:
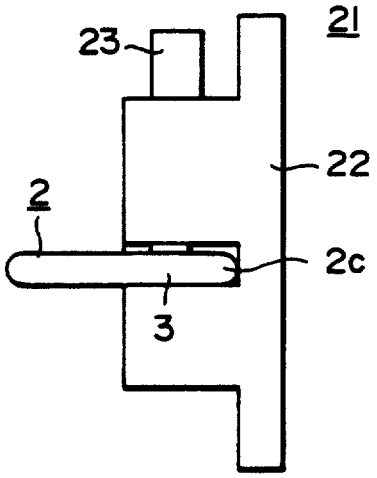
FIGS. 3(*a*)–(*d*) show a chain locking unit on a door.
Figure 3B:
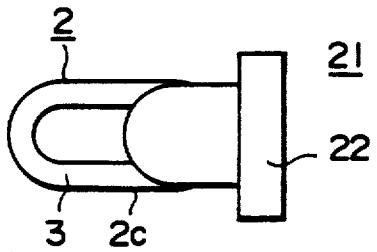
Figure 3C:
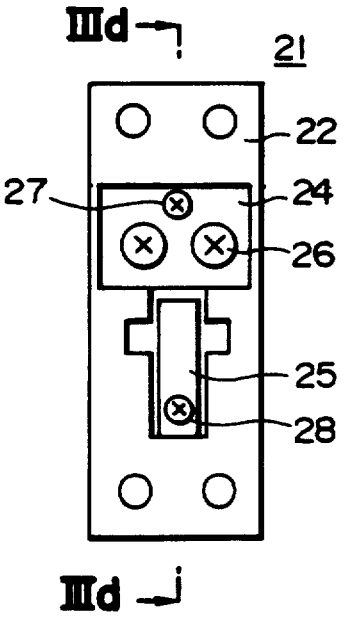
Figure 3D:
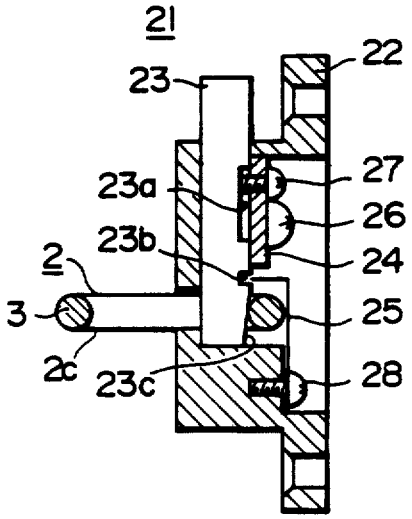

In the case when the engaging bolt 23 is placed in its lower position as shown in FIG. 3(d) (without engaging the link 3), the spring 25 is manually pushed out of the engaging groove 23b through the side clearance of the engaging bolt 23 and then the engaging bolt is pulled up by holding its upper part. Since the spring returns and abuts the engaging portion 23c of the engaging bolt 23 as shown in FIG. 6(b), the latter bolt 23 can be kept in the upper position. The link 3 of the free end link 2c of the chain is inserted into the door-side chain locking unit 21 and pushed forward to force the spring 25 out of its engagement with the engaging portion 23c of the engaging bolt 23. The engaging bolt therefore moves down and engages the link 3 as shown in FIG. 3.

In the case when the engaging bolt is placed in its upper position as shown in FIG. 6(b), the chain's free-end link 2c is inserted in the door-side chain locking unit 21 and pushed forward to force the spring 25 out of its engagement with the groove 23b, resulting in that the engaging bolt 23 moves down by force of gravity and engages the chain's free-ended link 3.

In the case of a hotel or a house, a room having only one access door 102, locked by the chain 2 as shown in FIG. 1, has to be opened by releasing the chain lock 1 from the outside, the engaging bolt 23 may be broken by outwardly pulling the door 102 with a certain amount of force, as for example, of the two persons causing the partial opening of the door as shown in FIG. 5. The door 102 can be fully opened by cutting the chain 23 with a cutting tool through the thus created clearance.

As is apparent from the foregoing description, since the door chain locking device, according to the present invention, comprises a door frame-side chain locking unit which has a locking bolt for permanently fixing thereon one end of the chain link and a case for securing said locking bolt thereto, and a door-side chain locking unit which is provided with an engaging bolt operable to engage thereon one of the middle part's links of the chain fixed at its fixed-end link to the locking bolt of the door-side chain locking unit and operable to engage the free-ended link of the chain when the door is closed and also to be lifted out of engagement with the free-end link of the chain after the disengagement of the middle part's link, it may be composed of a lesser quantity of elements and therefore may be manufactured at a lower cost.

It is also effective in that the door-side chain-locking unit, the engaging bolt has an engaging portion and a spring which is provided to abut said portion of the engaging bolt when said engaging bolt is lifted, thereby preventing the lowering of the engaging bolt. This makes it easier to fasten and release the door-chain lock.

I claim:

1. A door chain-locking device comprising a chain, a door-frame locking means locking one end of said chain, a door-side locking unit mounted on a door and comprising a mounting case slidably supporting a bolt for sliding movement between a lowered lock position and a raised unlock position, said bolt having a lower portion which is operable to lock an end link of said chain when said bolt is in said lowered lock position and which is operable to release said end link when said bolt is in said raised unlock position, said bolt having an upper portion which is freely exposed when said bolt is in said lowered lock position to receive an intermediate link of said chain to thereby provide a temporary fore-shortened chain portion extending between said bolt and said door-frame locking means to preclude any partial opening of said door, said door being partially openable as determined by the length of said chain when said intermediate link has been removed from said upper portion of said bolt and said end link is engaged by said bolt with said bolt being in its lowered lock position.

2. A door chain-locking device according to claim 1 further comprising a spring mounted on said mounting case, said spring having a biased holding position in which said spring engages said bolt to hold said bolt in said lowered lock position, said spring having a release position which releases said bolt for movement from its lowered lock to its raising unlock position.

3. A door chain-locking device according to claim 2, wherein said spring is disposed juxtaposed to said lower portion of said bolt such that said end link of said chain is manually manipulatable to engage and move said spring from its biased holding to its release position.

4. A door chain-locking device according to claim 3, wherein said spring is a leaf spring having one end secured to said mounting case and its other end engageable with said bolt.

5. A door chain-locking device according to claim 2, wherein said bolt has a groove for receiving said other end portion of said spring when said bolt is in said lock position.

6. A door chain-locking device according to claim 2, wherein said spring has an L-shaped configuration having a main part and an extending part extending from said main part, said main part having an end portion spaced from said extending part, fastening means fastening said end portion to said mounting case, said bolt having a groove, said groove receiving said extending part when said bolt is in said lock position and said spring is in said holding position.

7. A door chain-locking device according to claim 2, wherein said bolt has an engaging surface biasingly engageable by said spring when said bolt is in said raised unlock position to biasingly retain said bolt in said raised unlock position.

8. A door chain-locking device according to claim 7, wherein said bolt has a longitudinal axis, said engaging surface extending at an acute angle relative to said longitudinal axis.

9. A door chain-locking device according to claim 8, wherein said engaging surface is disposed on said lower portion of said bolt.

10. A door chain-locking device according to claim 1 further comprising limiting means on said mounting case and engageable with said bolt for limiting the upward slidable position of said bolt.

11. A door chain-locking device according to claim 7, wherein said bolt has a first groove parallel to said longitudinal axis, said mounting case having a projection slidably received in said groove, said bolt having a second groove which receives a part of said spring when said spring is in said biased holding position, said second groove being disposed between said first groove and said engaging surface.

12. A door chain-locking device according to claim 2, wherein said mounting case has an upper section spaced from a lower section, said bolt extending into said upper and lower sections and traversing said space between said upper and lower sections when said bolt is in said lock position such that said end link is secured by said bolt between said upper and lower sections, said bolt being raised into said upper section clear of said space when said bolt is in said raised unlock position to thereby permit said end link to be removed from said space between said upper and lower sections.

13. A door chain-locking device according to claim 12, wherein said spring is an elongate spring having one end fastened to said lower portion of said mounting case, said spring extending upwardly to said upper portion to traverse said space between said upper and lower portions, said spring being engageable by said end link to move said spring from its biased holding position to its release position.

* * * * *